US005536110A

United States Patent [19]

Tompkins et al.

[11] Patent Number: 5,536,110

[45] Date of Patent: Jul. 16, 1996

[54] TRANSITION COLLAR AND SPACING DEVICE FOR USE IN ROAD CONSTRUCTION

[76] Inventors: Kenneth Tompkins, 14 Garnett Dr., Ajay, Canada, L1S 4Z6; Artur Herter, 1445 Ondian Rd., Mississauga, Canada, L5H 1S5

[21] Appl. No.: 378,689

[22] Filed: Jan. 26, 1995

[30] Foreign Application Priority Data

Jun. 28, 1994 [CA] Canada ..... 2126900

[51] Int. Cl.[6] ..... F02D 29/14

[52] U.S. Cl. ..... 404/25; 52/20; 404/26

[58] Field of Search ..... 52/19, 20; 277/208; 404/25, 26, 19, 32

[56] References Cited

U.S. PATENT DOCUMENTS

| | | | |
|---|---|---|---|
| 3,263,580 | 8/1966 | MacMillan . | |
| 4,073,097 | 2/1978 | Jentoft et al. | 52/22 |
| 4,540,310 | 9/1985 | Ditcher et al. | 404/25 |
| 4,592,674 | 6/1986 | Baliva | 404/25 |
| 4,621,941 | 11/1986 | Ditcher et al. | 404/26 |
| 4,759,656 | 7/1988 | Wilson | 404/26 |
| 4,808,025 | 2/1989 | McGinnis . | |
| 4,909,519 | 3/1990 | Anderson | 277/207 A |
| 4,925,336 | 5/1990 | Simmonds . | |
| 4,927,290 | 5/1990 | Bowman . | |
| 4,936,703 | 6/1990 | Ferns | 404/25 |
| 4,969,771 | 11/1990 | Bowman | 404/26 |
| 5,030,030 | 7/1991 | Simmonds | 404/26 X |
| 5,044,818 | 9/1991 | Pritchard | 404/26 |
| 5,281,046 | 1/1994 | Suirklye | 404/26 |
| 5,308,188 | 5/1994 | Shaftner | 404/25 |
| 5,318,376 | 6/1994 | Prescott, Sr. | 404/25 |
| 5,360,131 | 11/1994 | Phillipps et al. | 404/26 X |
| 5,362,174 | 11/1994 | Yang | 404/25 |
| 5,404,676 | 4/1995 | Devlin | 404/25 X |

FOREIGN PATENT DOCUMENTS

| | | | |
|---|---|---|---|
| 2303122 | 11/1976 | France . | |
| WO93/485 | 1/1993 | WIPO | 404/25 |

*Primary Examiner*—William P. Neuder
*Assistant Examiner*—James A. Lisehora
*Attorney, Agent, or Firm*—Jeffrey Imai; Arne I. Fors; D. Doak Horne

[57] ABSTRACT

A transition collar for use in road construction comprises an annular collar member made of elastomeric materials such as rubber. It has a generally planar top surface and a central opening sized to accommodate a rigid frame structure having an access opening formed therein. The collar member has a vertical outer wall that faces the road material, which outer wall has a number of horizontally extending, spaced apart ridges formed thereon. These ridges assist in securing the collar in a road bed. Preferably the uppermost ridge is spaced below the top surface of the collar. The collar can have a number of small bumps distributed over its top surface to improve traction for vehicles. Preferably these bumps have sloping sidewalls extending about their periphery. A cushioning device is used to adjust the position of the frame structure and comprises a flat, elastomeric member with exterior dimensions corresponding to those of the frame structure. This cushioning device preferably has shallow indentations on one of its two major surfaces.

11 Claims, 4 Drawing Sheets

TRANSITION COLLAR AND SPACING DEVICE FOR USE IN ROAD CONSTRUCTION

FIELD OF THE INVENTION

This invention relates to improvements to manholes and catch basins, particularly those designed for use along or in a roadway carrying vehicular traffic and includes an improved transition collar for mounting around the top of a manhole.

BACKGROUND OF THE INVENTION

Manholes and catch basins for use along roads and streets have been known and used for quite some time. Many roads and streets have buried beneath them water lines, sanitary sewer lines and storm sewers. In order to permit access to these lines or pipes for purposes of repair, maintenance or inspection, manhole structures are provided at suitable locations along the road or street and these provide a vertical passageway by which one or more persons can gain access from ground level to the line or pipe. A common form of manhole includes a concrete enclosure that extends upwardly to a cast iron support frame in which is mounted a removable manhole cover, which cover is often circular. Ideally, the support frame and the manhole cover are mounted in such a way that the upper surface formed thereby is flush with the adjacent surface of the road or street. However, for reasons explained further hereinafter, it is quite common for the top of a manhole to sink or move out of alignment with the road surface with the passage of time, resulting in the formation of a cavity or hole in the road. Such holes can cause bumps for vehicular traffic and this can sometimes result in a dangerous situation.

Catch basins can be used in a variety of situations to gather ground water but perhaps most commonly they are used along the edge of paved streets or roadways, particularly ones that have some form of curb along one or both edges of the roadway. A common form of catch basin includes a concrete enclosure capable of holding water and having an open top covered with an iron grating which permits water to flow into the catch basin. Generally, the catch basin is connected by suitable piping to a nearby storm sewer line. Catch basins can be subject to the same problems as manholes, particularly if they are subjected to heavy vehicular traffic or the weight of large vehicles or trucks. Thus, the top of the catch basin can sometimes sink below the adjacent surface of the road or street.

One reason for the sinking of manhole tops is the use of rigid, annular concrete rings to adjust the height of the iron support frame at the top of the manhole. The constant and repetitive pounding of these adjustment rings by vehicles driving over the top of the manhole can eventually result in one or more of these rings being partially crushed or failing completely, thus allowing the top of the manhole to sink relative to the road surface. It is also possible for the top of the main manhole structure to wear away or fail with the passage of time, again permitting the top of the manhole sink.

Other difficulties can occur with known manhole and catch basin structures even when the top of the manhole or catch basin does non sink. For example, it can be difficult obtain optimum compaction of asphalt material adjacent the periphery of a manhole or catch basin and this can lead fairly rapid deterioration of the asphalt or other road surface adjacent to the manhole or catch basin. Furthermore, severe weather conditions or severe temperature changes can lead to expansion and contraction of the pavement, eventually leading to its breakup or cracking around the rigid structure formed by the manhole or catch basin. It should also be noted that once a bump develops at or around a manhole or catch basin, either the sinking of the manhole or catch basin or the deterioration of the adjoining flexible pavement surface can accelerate. This is because the existing bump will cause a rolling vehicle tire to generate an impact force which becomes greater with the size of the bump.

Recent U.S. Pat. No. 5,281,046 issued Jan. 25, 1994 to Domal Envirotech Inc. describes the use of a resilient, annular transition collar that can be placed around the top of a rigid roadway structure such as a manhole or catch basin. This collar acts as a flexible transition between the rigid frame of the structure and the semi-rigid or flexible asphalt paving. Adjustment rings can be provided below the collar in order to adjust its depth relative to the pavement surface and provide a flush fit. One perceived difficulty with this known transition collar however is that the joint between the outer peripheral wall of the collar and the adjoining pavement can deteriorate relatively quickly. One reason for this is that the movement of the resilient collar as vehicles pass over it tends to "pump" the adjacent granular material out of the space between the collar and the pavement. As this material is pumped out, water can seep into the space around the collar and the manhole. This water, particularly if it freezes in cold weather conditions, can eventually result in failure of either the top of the manhole structure or the adjoining pavement. In addition, such collars may work themselves partially out of the ground, thereby forming a potential road hazard.

U.S. Pat. No. 5,044,818 issued Sep. 3, 1991 to P. C. Pritchard describes a vertically adjustable manhole cover assembly. This assembly utilizes annular adjustment rings at both the top and bottom of a vertically adjusted annular sleeve positioned within the annular frame of the manhole cover supporting frame. The upper annular support ring includes an annular flange extending radially outwardly which is captured by the roadway resurfacing material so as to provide additional support to the cover assembly.

Also, recent U.S. Pat. No. 5,030,030 issued Jul. 9, 1991 Riedel Omni Products, Inc. describes a pad for supporting a utility access conduit in a roadway. The pad comprises a rectangular block of rubber or similar resilient elastomeric material which has an opening passing through it that snugly engages the access conduit. Shredded waste rubber from tires can be used to make the pad.

SUMMARY OF THE INVENTION

The present invention provides an improved transition collar for use in roadway construction, which collar is made of elastomeric material and is provided with means for improving the manner in which the collar is mounted in or supported in a roadbed.

The present invention also provides an improved cushioning device for use in mounting a rigid frame structure in a roadbed, which device is made of resilient, elastomeric material and has at least one surface with a number of shallow indentations formed on at least a substantial portion thereof. These indentations help to secure the cushioning device in place below the frame structure by means of butyl tape. The invention also provides an improved enclosure adapted for placement in or beneath a roadbed, which enclosure includes a rigid hollow structure, a metal frame structure mounted on top, a cover mounted to cover an access opening, and a cushioning device positioned between the metal frame structure and the hollow structure and made of resilient, elastomeric material.

According to one aspect of the invention, a transition collar for use in road construction comprises a collar member made of resilient, elastomeric material. This member has a generally planar top surface and a relatively large central opening sized to accommodate a rigid frame structure having an access opening formed therein. The collar member has a generally vertical outer wall adapted to face road building material. This outer wall has a number of horizontally extending, rigid spaced apart ridges formed thereon, which ridges assist in securing the collar in a roadbed.

Preferably the ridges include an uppermost ridge which is spaced below the top surface of the collar member as this will assist in sealing the gap between the collar and the adjoining roadbed.

According to another aspect of the invention, a transition collar for use in road construction comprises a collar member made of elastomeric material. This member has a top surface and a central opening sized to receive a rigid frame structure positioned in a road bed. The collar member has a number of small bumps distributed over its top surface to provide better traction for vehicles travelling over the collar. These bumps have sloping sidewalls extending about their periphery.

Preferably the bumps have rounded tops and the sidewalls extend at an angle of less than 45 degrees to the plane in which the top surface lies.

According to a further aspect .of the invention, a cushioning device for use in mounting a rigid frame structure in a road bed is used to cushion and adjust the position of the frame structure and comprises a generally flat, resilient elastomeric member having exterior dimensions generally corresponding with exterior dimensions of the frame structure. This elastomeric member extends around a hole formed by the member. At least one surface of the member has a number of shallow indentations formed on at least a substantial portion thereof.

In a preferred form of the cushioning device, there are a number of shallow indentations on two opposite surfaces of the device and these are distributed substantially evenly over the two surfaces.

According to a still further aspect of the invention, an enclosure for placement in or beneath a roadbed comprises a rigid hollow structure having sidewalls and a vertical passageway formed therein. This structure is adapted for burial in the ground. A metal frame structure is mounted on top of the hollow structure and forms an access opening for entry into the hollow structure. A cover is mounted in the metal frame structure and covers the access opening. A cushioning device is positioned between the frame structure and the hollow structure and it comprises a resilient, elastomeric member which is generally flat in a horizontal plane and has exterior dimensions generally corresponding with the exterior dimensions of the frame structure. This cushioning device has a hole aligned with the access opening and of similar size.

The aforementioned collar structure, frame structure and cover can form either a manhole or a catch basin.

Further features and advantages will become apparent from the following detailed description taken in conjunction with the accompanying drawings.

DESCRIPTION OF INVENTION

Figure 1:
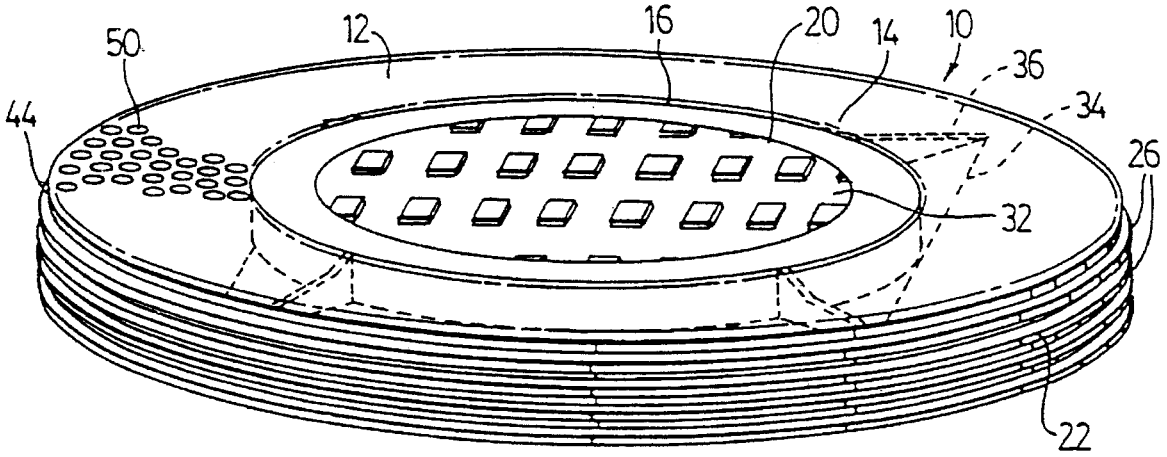
FIG. 1 is perspective view illustrating the combination of a manhole top with a transition collar constructed in accordance with the invention, this view being taken from the top and to one side.

FIG. 1 of the drawings illustrates a preferred form of transition collar constructed in accordance with the invention, this collar being designed for use in road construction or road repair. The transition collar comprises an annular collar member 10 made of resilient, elastomeric material such as rubber. The collar has a generally planar top surface 12 and a relatively large central opening 14 sized to accommodate a rigid frame structure 16 which may be the top of a manhole 18. The frame structure has an access opening 20 formed therein. The collar member has a generally vertical outer wall 22 adapted to face road building material such as gravel or pavement indicated at 24 in FIG. 2. Although an annular collar is shown, the collar member could also be square or rectangular both externally and internally about the opening 14. Other shapes are also possible, with the shape being largely dependent on the shape of the frame structure 16.

Figure 5:
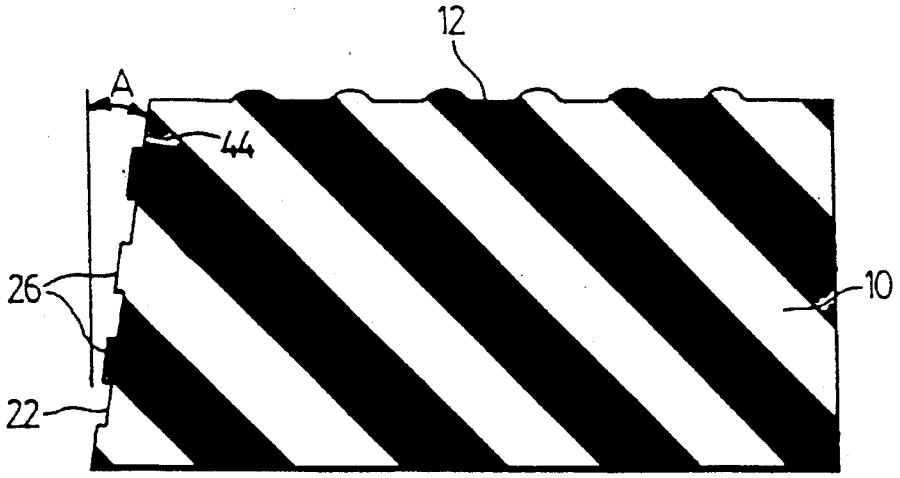
FIG. 5 is a cross-sectional elevation taken along the line V—V of FIG. 3.

As shown clearly in FIGS. 1 and 5, the collar member 10 has a number of horizontally extending, spaced-apart ridges 26 formed thereon. As explained in more detail hereinafter, these ridges 26 assist in securing the collar in a roadbed. In a preferred embodiment, the ridges 26 project horizontally from the outer wall a distance of about ⅛th inch or, in other words, they have a depth of about ⅛th inch. These ridges can be up to ¼ inch deep. Although the width of the ridges in the vertical direction can vary, they preferably have a width of at least ½ inch and in one particularly preferred embodiment, their width is ¾ inch. Preferably, these ridges are equally spaced apart.

It will be understood that one purpose of the transition collar is to help absorb any movement of the adjoining pavement that may be caused by changing weather conditions or severe weather. Changes in temperature and changes in the weather can cause the pavement to expand or contract. The collar helps to avoid problems of breakup, cracking and separation between the rigid manhole top and the flexible pavement since it provides a resilient, elastomeric transition. A further purpose of the collar is to help absorb shock and traffic vibration which can damage the road surface or the manhole or catch basin. The transition collar can also help to minimize damage that may result from earth tremors or soil movements.

The collar is preferably made from rubber or similar resilient, elastomeric material. The collar can in fact be made at least in part from recycled scrap rubber such as that produced from old rubber tires. Collars made from such rubber material have a long life expectancy, as much as 20 years and even longer. One Preferred formula for the collar (and the cushioning device described hereinafter) is as follows:

60% recycled rubber crumb

2% sulphur

5% coal dust

12% fiber

22% SBR (virgin rubber destined for landfill)

However these percentages can be varied to some extent. In addition to rubber, plastics can also be mixed into the compound to make the collar. The use of such collars should reduce the need for repairs or maintenance to the top of manholes and similar rigid structures. One reason for this is that the use of such collars can permit better compaction of the asphalt adjacent the manhole or catch basin. Heavy rollers used to provide compaction to asphalt can be safely run over these resilient collars without damage thereto and this in turn permits full and proper compaction of the adjacent asphalt. In the past, poor compaction of the asphalt has resulted in rapid deterioration of the pavement around manholes or catch basins.

Figure 2:
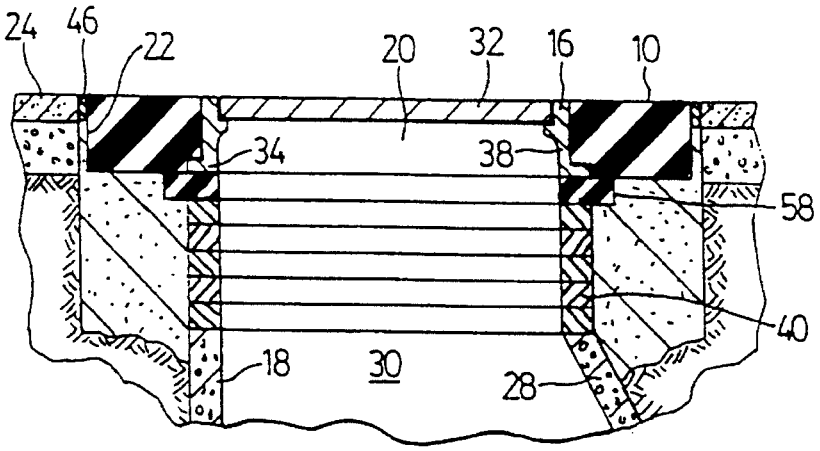
FIG. 2 is a cross-sectional elevation of the top of a typical manhole structure fitted with a transition collar.
Figure 4:
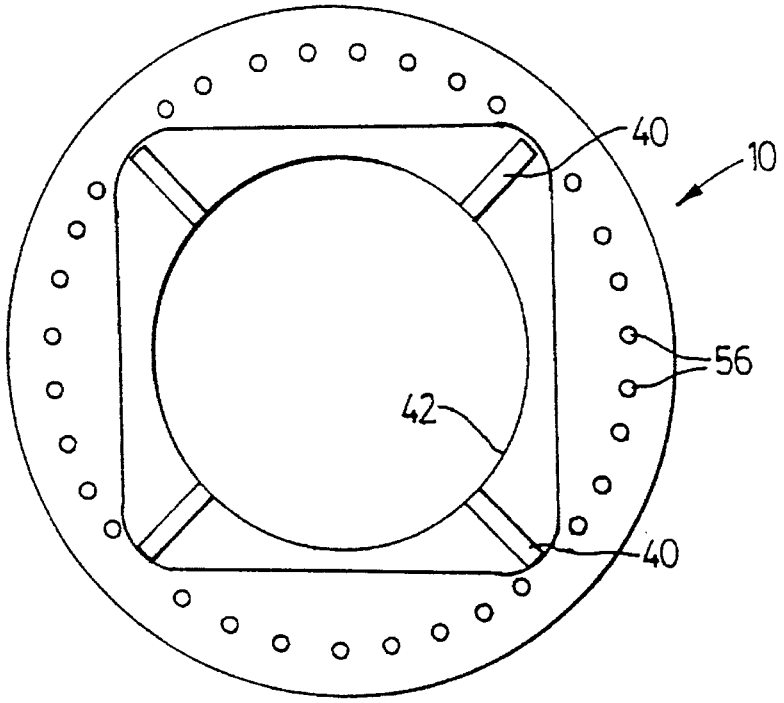
FIG. 4 is a bottom view of the transition collar of FIG. 3.

With reference FIG. 2 of the drawings, there is shown the top of an enclosure, namely a manhole structure placed in a roadbed. Except for the transition collar 10 and certain other details described hereinafter, the manhole 18 is of standard construction. The manhole includes a rigid hollow structure having sidewalls 28 that typically are made of concrete. This concrete may be treated with a waterproofing material to keep water out of the enclosure. The structure forms a vertical passageway indicated at 30 which may provide access to an underground pipe or pipes located at or near the bottom of the structure. Mounted on top of the manhole is the aforementioned metal frame structure 16 which forms its own access opening for entry into the hollow structure of the manhole. Typically, the structure 16 is made from heavy cast iron as is a cover 32 supported thereby. Quite often the structure 16 forms a circular opening but the opening can have other shapes such as square. The base 34 of the structure can be square as indicated in dashed lines in FIG. 1. Typically, support braces or brackets 36 extend upwardly from the base to a short, cylindrical portion 38 in order to give added strength to the structure. As shown in FIG. 4, the collar 10 can be formed with a number of slots 40 to accommodate these braces. It will be understood that these slots 40 are deep at the inside wall 42 of the collar and taper to a very shallow depth at the radially outer end thereof. The collar 10 is provided with a generally rectangular recess 41, preferably with rounded corners at 43. The depth of this recess varies from frame to different frame but in one typical embodiment it is one inch deep. The recess is large enough to accommodate and receive the base 34 of the metal structure 16. The collar 10 should extend down to the bottom of the structure 16 and it should rest on the base 34. In this way the collar is always maintained at the same level as the structure 16.

It is generally necessary to adjust the height of the frame structure 16 so that the manhole cover 32 will form a smooth, flush surface with the adjoining road. This has been accomplished in the past by using one or more precast concrete risers 40 which can be annular in the case of a manhole having a round top. In the past, these risers have often be subject to damage and failure with the passage of time due to shock forces and vibration caused by traffic over the rigid top of the manhole. Such damage can be particularly pronounced if an elastic transition collar is positioned around the manhole. As explained further hereinafter, the present invention provides a spacing device that can alleviate this problem.

Returning now to the construction of the preferred collar member 10, the ridges 26 as shown extend completely around the annular collar member. Ridges that have gaps between them at regular intervals around the collar could also be used, if desired. Preferably, the uppermost ridge is spaced below the top surface 12 of the collar member so as to form a gap indicated at 44 between the uppermost ridge and the top surface. This gap or groove is desirable in order to receive hot sealant which is applied around the outer periphery of the collar 10 after it is installed. This sealant indicated at 46 in FIG. 2 is necessary to prevent water from entering the space between the pavement material 24 and the collar. Hot tar is the recommended sealant.

Preferably the outer wall 22 of the collar has a slight taper in the upwards direction as illustrated in FIG. 5. This taper (which is exaggerated in the drawing) is indicated by the angle A. As a result, the collar has a smaller diameter at the top of the outer wall compared to the diameter at the bottom thereof. In one preferred embodiment, the amount of the taper is only one quarter inch over the height of the collar, which height is typically 5 ¾ inches. It will be understood that once the collar 10 has been mounted around the top of the manhole structure at the proper height, it becomes necessary to fill in the gap between the outerwall of the collar and the adjacent pavement. This gap should be made narrow so that the adjoining pavement will not be disturbed more than necessary. However, it must be wide enough to permit the gap to be filled and sealed in an appropriate manner as hereinafter described. Preferably the gap between the outer wall of the collar and the pavement is about ⅜th inch. Preferably this gap is filled with cold asphalt material that is brushed into the gap and tamped and compressed thoroughly. The aforementioned sealant 46 is then used to seal the gap. If the outer wall of the collar is straight and vertical as taught in U.S. Pat. No. 5,281,046, the outer wall will with time tend to "pump out" the granular material or cold asphalt that has been used to fill the aforementioned gap. This pumping action is a result of the movement of the rolling tires over the collar and the fact that the collar is made from a resilient, elastomeric material that will tend to give or move as force is applied to the top surface of the collar. However, with the use of the horizontal ridges 26, this pumping action is stopped. It is believed that the ridges tend to prevent the cold asphalt and sealant from sliding upwardly along the outer wall to the road surface. The provision of the upward taper to the outer wall helps to prevent movement of the resilient collar relative to the adjoining pavement and also makes it easier to insert the cold asphalt into the gap between the collar member and the pavement. It is believed that this slight taper makes it more difficult for the collar to "walk up" the side of the hole formed for it. Again, it will be appreciated that in the absence of such a taper and the ridges 26, the force and impact caused by tires rolling over the collar can cause it to shift its position and can cause the outer wall to be pushed upwardly relative to the adjoining pavement, the so-called "walking up" action.

Figure 3:
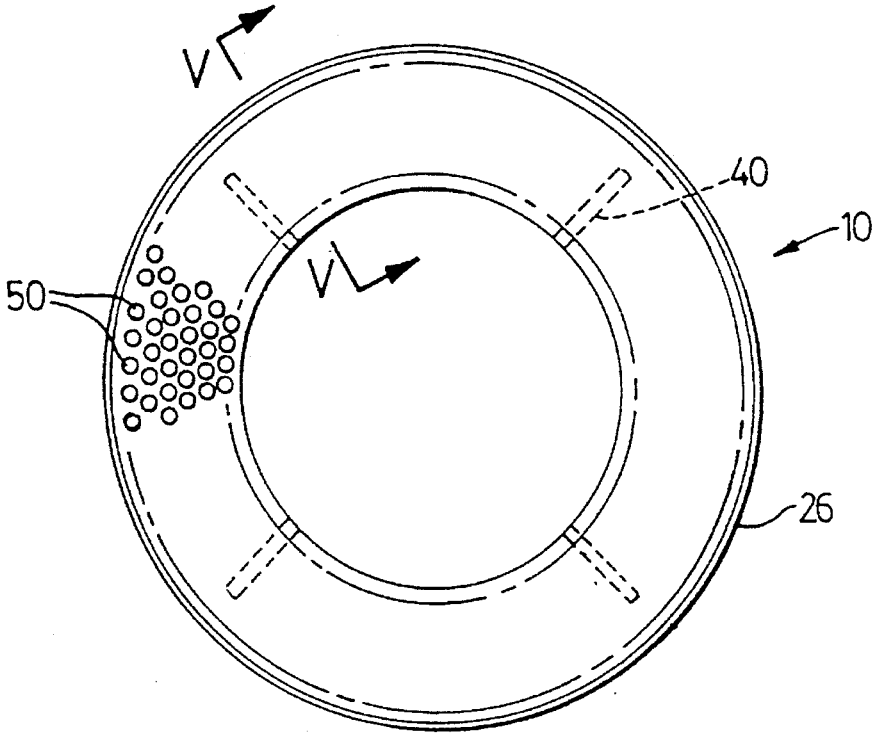
FIG. 3 is a top view of the preferred transition collar having a textured top surface.
Figure 6:
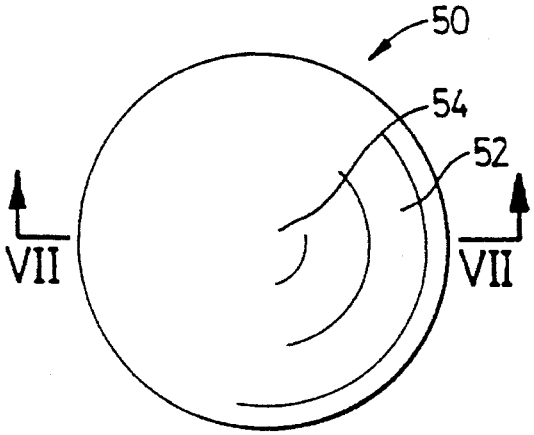
FIG. 6 is a plan view illustrating a preferred form of grip-providing bump for the top surface of the collar.
Figure 7:
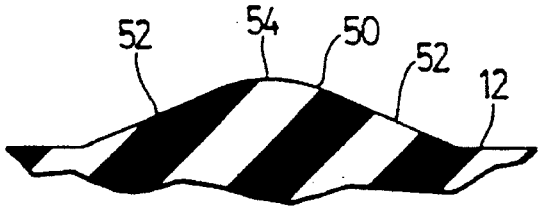
FIG. 7 is a cross-sectional elevation taken along the line VII—VII of FIG. 6.

FIG. 3, 6 and 7 illustrate another improvement in the transition collar of the invention. In particular, the collar member 10 has a number of small bumps distributed over the top surface 12 to provide better traction for vehicles travelling over the collar. As illustrated clearly in FIG. 7, these preferred bumps have sloping sidewalls 52 extending about their periphery. Their preferred height is between 3/16th inch and ¼ inch. Preferably the bumps have rounded tops 54 and the sidewalls extend at an angle of less than 45 degrees to the plane of the top surface 12. Although the illustrated bumps are circular in plan view and have a generally conical sidewall 52, it will be appreciated that these bumps could also have a pyramidal shape with a rounded top or, in other words, four sloping sidewalls extending upwardly from a square base. Bumps or buttons of this configuration provide more contact or gripping surface between the tire of the vehicle and the transition collar. In addition, a bump with a sloping sidewall has the advantage of permitting a snow plough blade to slide relatively easily over the transition collar without damaging the collar to any appreciable extent. The rounded top and sloping sidewall of the bumps also allow for better run off of water and help to deflect sideload on the collar.

The bottom view of FIG. 4 illustrates that the preferred version of the transition collar has a number of vertically extending holes 56 of circular cross-section formed therein. These holes extend upwardly from the bottom surface of the collar and are closed at the top. In the illustrated version, there are eight such holes in each of the four quadrants of the collar. These holes are curing holes that are formed during the making and curing of the collar by heated curing rods. As indicated, these collars can be made from scrap rubber using a compression molding operation. The provision of the holes 56 in the collar expedites the curing process because the curing rods are able to penetrate the body of the collar during the "curing process".

In one preferred embodiment of the transition collar, it has an outside diameter of 47 ½ inches. Generally speaking, for most manhole uses, the external diameter at the bottom edge of the outer wall of the collar would be between 3 and 4 feet, the exact external diameter depending upon the size of the manhole frame structure and the transition distance desired. For many applications, the collar can have a thickness in the vertical direction of between 5 and 10 inches. In one particular preferred embodiment, the thickness is 5 ¾ inches or 146.5 mm.

Figure 8:
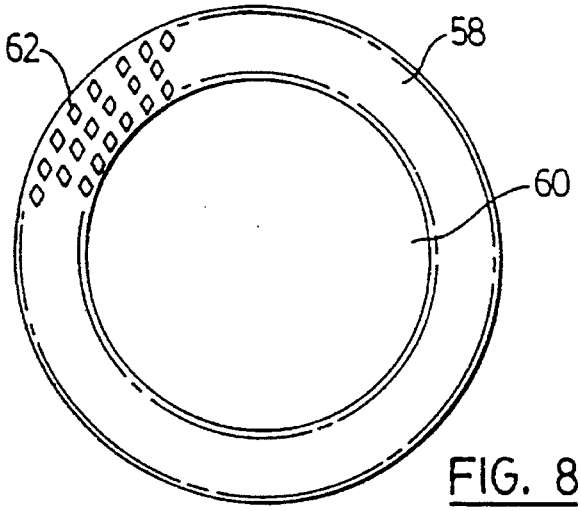
FIG. 8 is a top view of a manhole adjustment ring.
Figure 9:
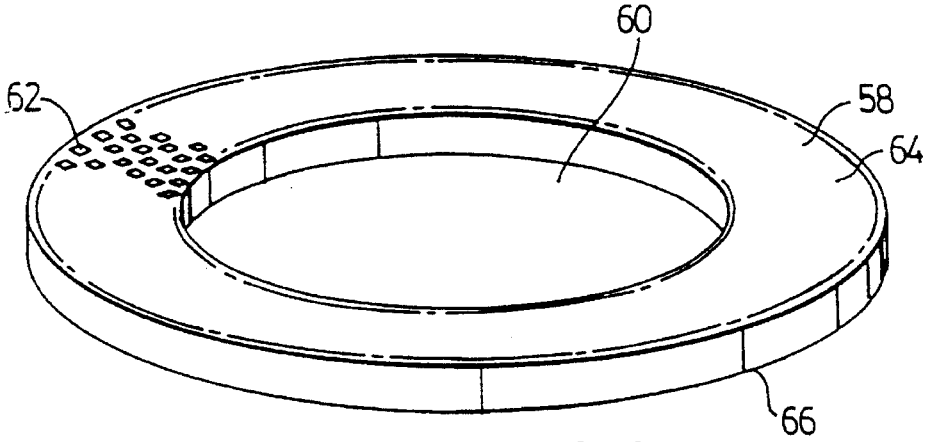
FIG. 9 is perspective view of the adjustment ring of FIG. 8.

Illustrated in FIGS. 8 and 9 is an annular cushioning device 58 that can be used for mounting the rigid frame structure, such as the aforementioned manhole frame structure 16, in a roadbed. This device is used to cushion and adjust the position of, including the height of, the frame structure. The device 58 comprises a resilient, elastomeric member which is generally flat in a horizontal plane and has exterior dimensions generally corresponding with exterior dimensions of the frame structure that it is designed for use with. By saying its dimensions "generally correspond", the applicant intends to include the situation shown in FIG. 2 when the outside diameter of the cushioning device somewhat exceeds the corresponding dimension of the frame structure 16 which, as shown, has a rectangular or square base. This is possible in some directions when the cushioning device is rounded instead of square or rectangular. The member 58 extends around a circular hole 60 defined by the member. The member 58 shown in FIG. 2 is annular and has an external diameter corresponding to the maximum diagonal width of the rectangular base 34 of the structure 16. Thus the cushioning device 58 should extend below and support the entire bottom surface of the metal frame structure 16. At lease one surface of the member has a number of shallow indentations 62 formed on at least a substantial portion thereof. Preferably, the indentations extend over two opposite major surfaces 64 and 66 of the device and they are distributed substantially evenly over these two surfaces. The indentations in one preferred embodiment are diamond shaped and are spaced apart from one another. In this embodiment, the maximum depth of the indentations does not exceed 3/32nds of an inch. The preferred cushioning device is made of rubber or a rubberlike material and scrap rubber can be used if desired to produce these devices. The use of the cushioning device 58 is illustrated in FIG. 2 where it has been placed on top of a series of concrete risers 40 located at the top of the main manhole structure. Thus, the elastomeric spacer 58 is positioned between the concrete risers and the rigid metal structure 16 at the top of the manhole. It will also be appreciated that if the height of the manhole does not necessitate the use of the risers 40, the spacing device 58 could be located directly between the top of the sidewalls 28 and the metal structure 16. The purpose of the elastomeric cushioning device 58 is not only to act as a spacer for adjusting the height of the top of a manhole but also to help absorb or cushion the shocks and vibrations to which the rigid frame structure 16 is subjected. By the use of such a cushioning device, the life of the manhole structure can be increased and the amount of maintenance and repairs can be reduced. If concrete risers 40 have been used an the top of the manhole, they will not be as subject to crushing or failure as is the case when no elastomeric cushioning device has been used. The purpose of the shallow indentations in one or both major surfaces of the device is to give the surface the required texture so that a standard adhesive fastener such as butyl tape can be used to secure the member 58 in place. Butyl tape, which is a known adhesive material, can be used to adhere the device 58 both to an underlying concrete surface such as the top of a riser 40 and to the rigid metal frame structure 16 mounted above the member 58. Although diamond shaped indentations are shown in the drawings, obviously the indentations could have other shapes such as circular or square. Instead of butyl tape, it is also possible to secure the device 58 in place using hot tar as the adhesive material.

It should also be understood that it is possible to use more than one of the cushioning devices 58 and to position them between the rigid frame structure at the top of the manhole and the hollow concrete structure below the frame structure. For example, one could use two or more cushioning devices 58 in order to raise the structure 16 to the required height so that it is flush with the surface of the road. Preferably, the cushioning devices 58 are manufactured and provided in several different thicknesses to enable the user to properly adjust the distance between the underlying concrete hollow structure of the manhole and the top metal frame structure 16. Typical thicknesses for these cushioning devices would be 2 inches and 3 inches but they can range in thickness from as little as ¼ inch to 3 inches depending on customer and job requirements.

Figure 10:
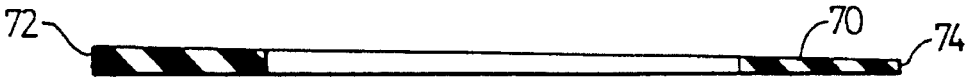
FIG. 10 is a cross-sectional elevation of another form of adjustment ring, this one being wedge-shaped.

It is also possible to make a cushioning device 70 of the type illustrated in FIG. 10. This elastomeric cushioning device is also intended for positioning between a rigid frame structure and an underlying hollow structure. The cushioning device 70 has a wedge-shape in side elevation so that its thickness varies uniformly from one edge 72 to the opposite edge 74. A wedge-shaped cushioning device can be used to provide the rigid frame structure 16 with a slope matching that of the adjacent roadway surface. Again, more than one of the cushioning devices 70 could be used, if required, or cushioning device 70 can be used in combination with the cushioning devices 58 having a uniform thickness.

Figure 11:
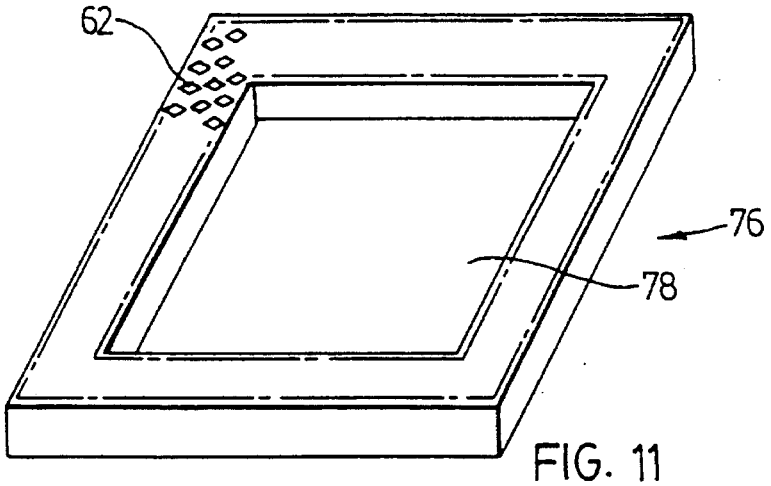
FIG. 11 is a perspective view of another form of adjustment ring, this one having a square shape for use in a catch basin structure or a square manhole.
Figure 12:
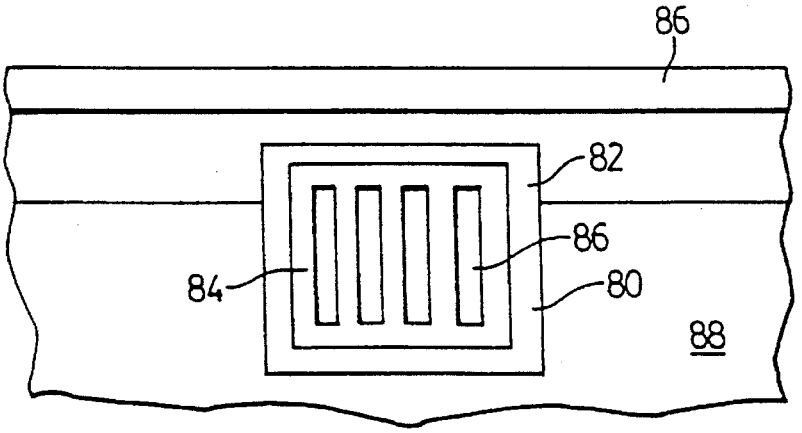
FIG. 12 is a schematic plan view of a typical catch basin installation next to a concrete curb.

FIG. 11 illustrates a cushioning device 76 that has a square or rectangular outer periphery and the hole 78 formed therein is square or rectangular. This elastomeric cushioning device can be used either with a manhole having a square top or with a standard catch basin such as the catch basin 80 illustrated in FIG. 12. This catch basin has a rigid, metal frame structure 82 which is square or rectangular in plan view. It is also possible to have round catch basins. Fitted into this frame structure is a square catch basin cover 84 which is generally in the form of a metal grating having slots 86 or other suitable openings for the passage of water into the catch basin. It will be understood that the frame structure 82 is mounted on top of a ridge hollow structure which is often made of concrete and which generally has four sidewalls and a bottom. This hollow structure forms a vertically extending passageway that can contain or hold water that has run into the catch basin. Often the catch basin is mounted in or beside a concrete curb 86 that extends along a side edge of a roadway or street 88.

The cushioning device 76 can also be provided with shallow indentations 62 on one or both major surfaces located on opposite sides thereof.

Like the transition collar, the cushioning devices can also be formed by compression moulding and the raw material that can be used for the elastomeric material can include suitable scrap rubber, such as that produced from old tires. Plastics material can also be mixed into the compound to make these cushioning devices.

It will be readily apparent to those skilled in this art that various modification and changes can be made to the transition collars and cushioning devices disclosed herein without departing from the spirit and scope of this invention. Accordingly, all such modifications and changes as fall within the scope of the appended claims are intended to be part of this invention.

We claim:

1. An enclosure for placement in or beneath a road bed comprising:

a rigid hollow structure having sidewall and a vertical passageway formed therein, said structure being adapted for burial in the ground;

a metal frame structure mounted on top of said hollow structure and forming an access opening for entry into said hollow structure;

a cover mounted in said metal frame structure and removably covering said access opening;

a cushioning device positioned between said frame structure and said hollow structure and comprising a resilient, elastomeric member which is generally flat in a horizontal plane and has exterior dimensions generally corresponding with exterior dimensions of said frame structure, said cushioning device has a hole aligned with said access opening and of similar size, said cushioning device having two major surfaces, at least one of which has a plurality of shallow indentations for texturing the major surface for receiving an adhesive;

an adhesive for retaining said cushioning device between said frame structure and hollow structure: and a transition collar made of an elastomeric material mounted around said metal frame structure, said transition collar having a generally planar top surface and a relatively large opening sized to accommodate said rigid frame, said collar having an outer wall having a plurality of horizontally extending, spaced apart ridges, wherein said ridges assist in security said collar in a road bed.

2. An enclosure according to claim 1, wherein said hollow structure, frame structure and cover together form a manhole providing a vertical passageway for one or more persons to go below ground for repair, inspection or other purposes.

3. An enclosure according to claim 1, wherein said hollow structure, frame structure and cover together form a catch basin and said cover is formed with slots or other suitable openings for the passage of surface water into said catch basin.

4. An enclosure according to any one of claims 1, 2 or 3 including one or more additional cushioning devices for positioning between said frame structure and said hollow structure, wherein the cushioning devices are of different thickness to enable adjustment of the distance between said hollow structure and said metal frame structure.

5. An enclosure according to any one of claims 1, 2 or 3 including one or more additional cushioning devices for positioning between said frame structure and said hollow structure, at least one of the cushioning devices having a wedge-shape in side elevation so that its thickness varies uniformly from one edge to an opposite edge thereof.

6. An enclosure according to claim 3, wherein said cushioning device has a square or rectangular outer periphery and said hole formed therein is square or rectangular.

7. An enclosure as claimed in claim 1 wherein said cushioning device and transition collar is made from a mixture of materials that include recycled rubber.

8. An enclosure as claimed in claim 1 wherein said outer wall of said transition collar has a taper narrowing in an upward direction.

9. An enclosure as claimed in claim 8 wherein said ridges include an uppermost ridge which is spaced below said top surface.

10. An enclosure as claimed in claim 9 wherein said top surface is textured to provide a tire gripping surface.

11. An enclosure as claimed in claim 9 wherein said top surface has a plurality of small bumps distributed over said top surface, said bumps having sloping sidewalls about their periphery.

* * * * *